US011624500B2

(12) United States Patent
Kim

(10) Patent No.: US 11,624,500 B2
(45) Date of Patent: Apr. 11, 2023

(54) SLIM-TYPE LED LIGHTING APPARATUS WITH INTEGRATED JUNCTION BOX AND LED MODULE

(71) Applicants: SEOHYUN INTERNATIONAL CORP., Nonsan-si (KR); DJ Co., Ltd., Nonsan-si (KR)

(72) Inventor: Doo Joon Kim, Seoul (KR)

(73) Assignees: SEOHYUN INTERNATIONAL CORP., Nonsan-si (KR); DJ Co., Ltd., Nonsan-si (KR)

( * ) Notice: Subject to any disclaimer, the term of this patent is extended or adjusted under 35 U.S.C. 154(b) by 0 days.

(21) Appl. No.: 17/645,750

(22) Filed: Dec. 23, 2021

(65) Prior Publication Data

US 2023/0032592 A1 Feb. 2, 2023

(30) Foreign Application Priority Data

Jul. 27, 2021 (KR) ..... 10-2021-0098609

(51) Int. Cl.

| | |
|---|---|
| ***F21V 23/00*** | (2015.01) |
| ***F21V 21/088*** | (2006.01) |
| ***F21V 23/06*** | (2006.01) |
| *F21Y 115/10* | (2016.01) |

(52) U.S. Cl.

CPC ..... *F21V 23/006* (2013.01); *F21V 21/088* (2013.01); *F21V 23/06* (2013.01); *F21Y 2115/10* (2016.08)

(58) Field of Classification Search

CPC .... F21Y 2115/10; F21V 23/06; F21V 21/088; F21V 23/006

See application file for complete search history.

(56) References Cited

U.S. PATENT DOCUMENTS

| | | | | |
|---|---|---|---|---|
| 10,393,359 | B1 * | 8/2019 | Qi | F21V 23/008 |
| 11,085,597 | B2 * | 8/2021 | Danesh | F21S 8/026 |
| 11,274,821 | B2 * | 3/2022 | Danesh | F21V 29/773 |
| 11,384,910 | B1 * | 7/2022 | Cohen | F21S 8/02 |
| 2021/0364139 | A1 * | 11/2021 | Danesh | F21S 8/026 |

FOREIGN PATENT DOCUMENTS

KR 10-2020-0070661 A 6/2020

* cited by examiner

*Primary Examiner* — Anabel Ton

(74) *Attorney, Agent, or Firm* — ArentFox Schiff LLP

(57) ABSTRACT

Proposed is a slim-type LED lighting apparatus with integrated junction box and LED module. The apparatus includes: the junction box having a plurality of first cable inlets that allow circular cables or conduits to be introduced thereinto and are arranged on a circumference of a side surface of a cylindrical body with an open upper side and a recessed lower side, an upper opening into which a wiring cover is coupled to be selectively openable and closable for wiring work, and a lower recess having a first flange protruding from the cylindrical body; the LED module inserted through the lower recess of the junction box and then integrally coupled to a lower surface of the junction box in face-to-face contact therewith; and a plurality of interchangeable trims of different diameters selectively coupled to a lower portion of the junction box and configured to be interchangeable with each other.

13 Claims, 6 Drawing Sheets

SLIM-TYPE LED LIGHTING APPARATUS WITH INTEGRATED JUNCTION BOX AND LED MODULE

CROSS REFERENCE TO RELATED APPLICATION

The present application claims priority to Korean Patent Application No. 10-2021-0098609, filed Jul. 27, 2021, the entire contents of which is incorporated herein by reference for all purposes.

FIELD OF THE INVENTION

The present disclosure relates generally to a slim-type LED lighting apparatus with integrated junction box and LED module. More particularly, the present disclosure relates to a slim-type LED lighting apparatus with integrated junction box and LED module, in which the junction box, which was separately provided outside the related-art lighting apparatus, is integrated with the LED module, and the junction box also serves as a heat sink, thereby enabling size reduction and slimming of the lighting apparatus. In addition, trims having different diameters are selectively coupled to a lower portion of the integrated junction box and LED module to be easily interchangeable with each other by spring clips, so that the apparatus is easily installed by interchanging only the trims in the field depending on design specifications or the construction situation of a work site.

BACKGROUND OF THE INVENTION

In general, a buried luminaire, i.e., a buried lighting apparatus, is installed by being embedded in a hollow opening in a ceiling or other surface of a building. Such a buried lighting apparatus typically includes a support frame and a lighting module supported by the support frame. The support frame is fixed to a wall and a column serving as a support member by a connecting means.

Referring to FIG. 1, a buried lighting apparatus 100 according to the related art includes a light source unit 110 that emits light, a driver 120 that converts power supplied from the outside to drive the light source unit 110, and the light emitted from the light source unit 110, a reflector 130 that reflects the light emitted from the light source unit 110 and discharges the reflected light to the outside, a heat sink 140 that is coupled in thermal contact with the light source unit 110 and the driver 120 and the driver 120 and discharges heat of the light source unit 110 and the driver 120 to the outside, and a reflector housing 150 that surrounds and protects the outside of the reflector 130.

The above-described buried lighting apparatus 100 according to the related art has a structure in which the reflector 130, the light source unit 110, the heat sink 140, and the driver 120 are sequentially stacked and combined together, and a junction box 200 for wiring various cables C is separately installed outside the lighting apparatus 100. This results in an increase in overall size of the lighting apparatus 100 and the junction box 200, causing inconvenience in handling and installation in the field, and an increase in cost of the lighting apparatus 100.

With the recent increase in demand for a slim lighting apparatus using a light emitting diode (LED) as the light source unit 110 of the buried lighting apparatus 100, the development of a slim LED lighting apparatus is being actively conducted.

Meanwhile, the size of a trim at the bottom of a reflector may vary depending on the design specifications of a building or the construction situation of a work site when a lighting apparatus is installed, so it is necessary to purchase lighting apparatuses of different diameter sizes separately in advance. However, when the number of purchased lighting apparatuses is not accurate, many inconveniences such as delays in construction work are caused.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a slim-type LED lighting apparatus with integrated junction box and LED module, in which the junction box installed separately outside a related-art lighting apparatus is integrated with the LED module, thereby enabling size reduction and slimming of the lighting apparatus, the junction box also serves as a heat sink, and the apparatus is easy to handle and install in the field.

Another objective of the present disclosure is to provide a slim-type LED lighting apparatus with integrated junction box and LED module, in which trims having different diameters are selectively coupled to a lower portion of the integrated junction box and LED module to be easily interchangeable with each other by spring clips, so that the apparatus is easily installed by interchanging only the trims in the field depending on design specifications or the construction situation of a work site.

In order to achieve the above objectives, according to one aspect of the present disclosure, there is provided a slim-type LED lighting apparatus with integrated junction box and LED module, the apparatus including: the junction box having a plurality of first cable inlets that allow circular cables or conduits to be introduced thereinto and are arranged on a circumference of a side surface of a cylindrical body with an open upper side and a recessed lower side recessed to a predetermined depth, an upper opening into which a wiring cover is coupled to be selectively openable and closable for wiring work, and a lower recess having a first flange protruding from the cylindrical body by a predetermined width; the LED module inserted through the lower recess of the junction box and then integrally coupled to a lower surface of the junction box in face-to-face contact therewith; and a plurality of interchangeable trims of different diameters selectively coupled to a lower portion of the junction box and configured to be interchangeable with each other.

According to an embodiment, each of the interchangeable trims of different diameters may have a second flange protruding from an upper end thereof by a width corresponding to that of the first flange at a lower side of the junction box, and a plurality of rotation clips are provided on a circumference of the second flange. Here, when the rotation clips are selectively rotated toward the first and second flanges, the rotation clips may be simultaneously clamped and secured to the first flange and the second flanges.

According to an embodiment, each of the first cable inlets of the junction box may be normally blocked by a knockout plug inserted thereinto, and if necessary, the respective knockout plugs may be removed and then the circular cables or conduits may be inserted into the first cable inlets and connected to the inside of the junction box.

According to an embodiment, a second cable inlet having a rectangular opening to allow a flat cable having a flat cross-section to be introduced thereinto may be further formed between each of the first cable inlets.

According to an embodiment, the circular cables or conduits introduced into the junction box through the first cable inlets or the respective flat cables introduced into the junction box through the second cable inlets may be electrically connected to the LED module through a wiring hole famed in the lower surface of the junction box.

According to an embodiment, a lens may be further provided in the lower recess of the junction box to cover the LED module integrally coupled to the lower surface of the junction box.

According to an embodiment, as the LED module is integrally coupled to the lower surface of the junction box by the face-to-face contact therebetween, heat generated from the LED module may be transferred to the junction box through the lower surface of the junction box and then dissipated into the air.

According to an embodiment, a plurality of spring clips may be further coupled to a lower surface of the second flange of each of the interchangeable trims to secure the interchangeable trim to a ceiling surface by elastically pressing top of the ceiling surface in a state in which the interchangeable trim is embedded in an installation hole of the ceiling surface.

According to an embodiment, the LED module may be configured such that when viewed from below, a plurality of LED devices are centrally disposed on a circular printed circuit board, and a color temperature conversion switch and a power control switch are provided on the printed circuit board at left and right sides of the LED devices, respectively.

According to an embodiment, each of the color temperature conversion switch and the power control switch may have a lever, and the respective levers may protrude from an upper surface of the printed circuit board and are exposed inside the junction box through respective switch lever slots, each of which is formed at a side of the lower surface of the junction box. Here, when the switches are needed to be operated, the wiring cover may be opened and then the levers protruding through the switch lever slots inside the junction box may be operated.

According to an embodiment, the LED module may be integrally coupled to the lower surface of the junction box in face-to-face contact therewith by screws or rivets.

According to an embodiment, a cable connector may be further provided inside the junction box to allow the cables introduced into the junction box through the first or second cable inlets to be connected to each other.

According to an embodiment, a holder plate may be further provided on rear surfaces of the respective second cable inlets inside the junction box to press the respective flat cables inserted into the second cable inlets so as not to become loose and come out of the second cable inlets.

According to the present disclosure as described above, the junction box, which was separately provided outside the related-art lighting apparatus, is integrated with the LED module, and the junction box also serves as a heat sink. This enables size reduction and slimming of the lighting apparatus, thereby facilitating handling and installation in the field.

In addition, trims having different diameters are selectively coupled to the lower portion of the integrated junction box and LED module to be easily interchangeable with each other by the spring clips, so that the apparatus can be easily installed by interchanging only the trims in the field depending on design specifications or the construction situation of a work site.

BRIEF DESCRIPTION OF THE DRAWINGS

The above and other objectives, features, and other advantages of the present disclosure will be more clearly understood from the following detailed description when taken in conjunction with the accompanying drawings, in which:

FIGS. 2A to 2C are perspective views illustrating a slim-type LED lighting apparatus with integrated junction box and LED module according to an embodiment of the present disclosure, in which FIG. 2A illustrates a state before trims of different sizes are coupled to the junction box and the LED module, FIG. 2B illustrates a state in which a trim of 4 inches diameter is coupled, and FIG. 2C illustrates a state in which a trim of 6 inch diameter is coupled;

FIG. 2C is applied.

DETAILED DESCRIPTION OF THE INVENTION

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this disclosure belongs.

It will be further understood that tams, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, the configuration and operation relationship of a slim-type LED lighting apparatus with integrated junction box and LED module according to the present disclosure will be described in detail with reference to the accompanying drawings.

Figure 1:
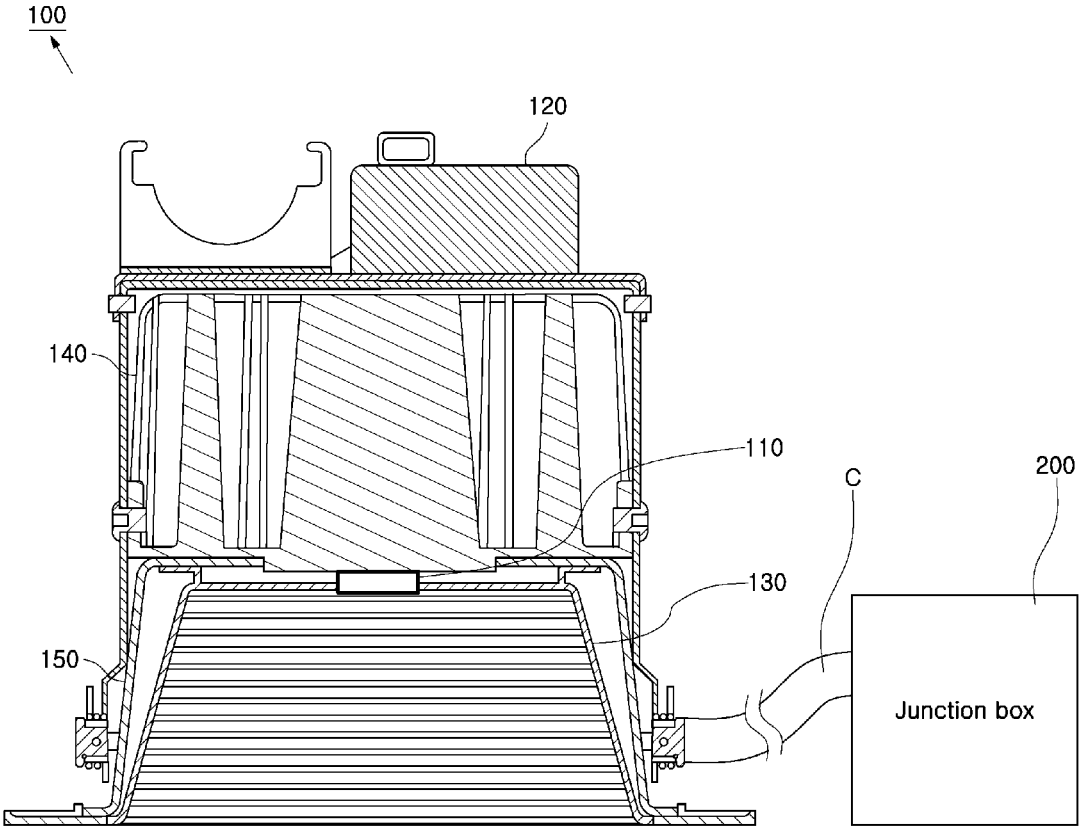
FIG. 1 is a longitudinal sectional view exemplarily illustrating the configuration of an LED lighting apparatus according to the related art.
Figure 2A:
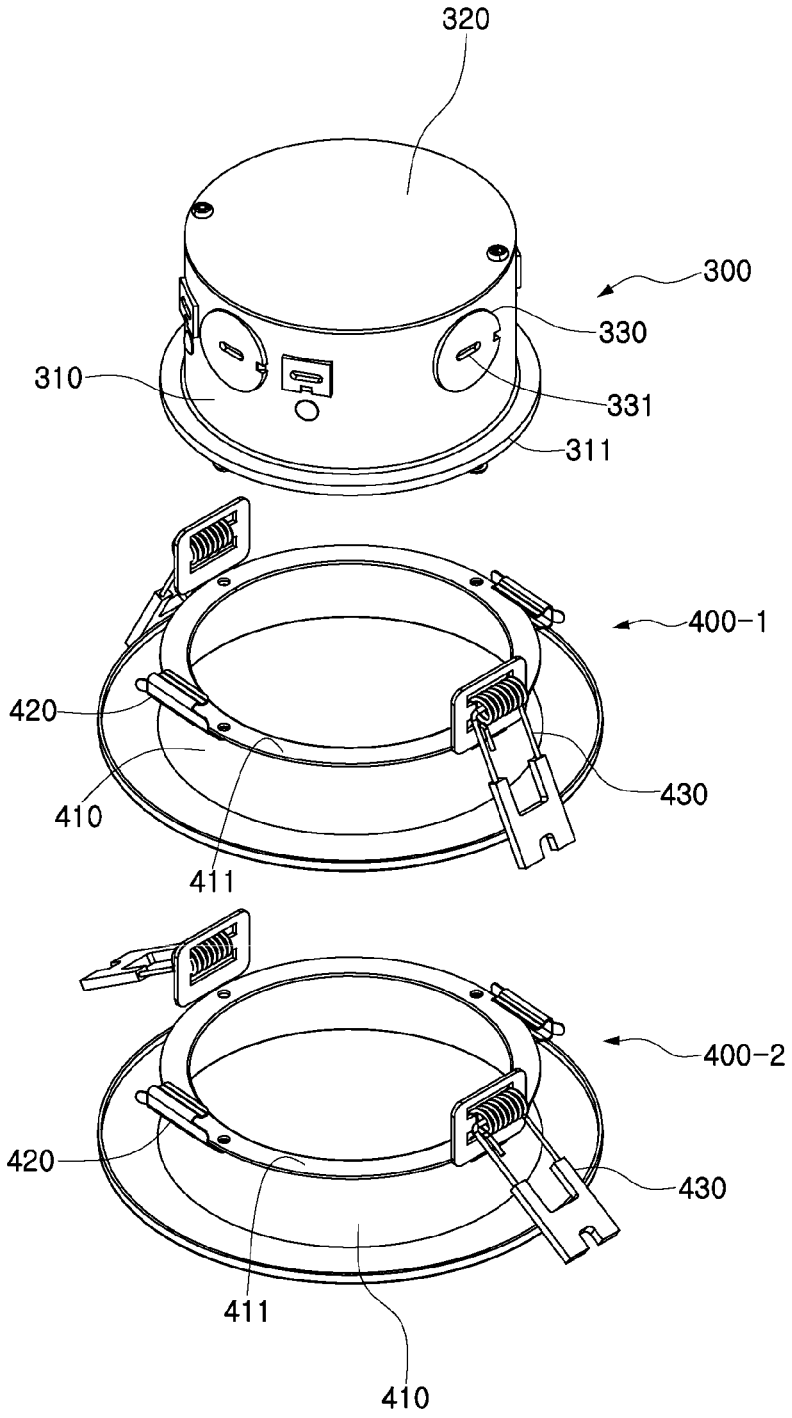
Figure 2B:
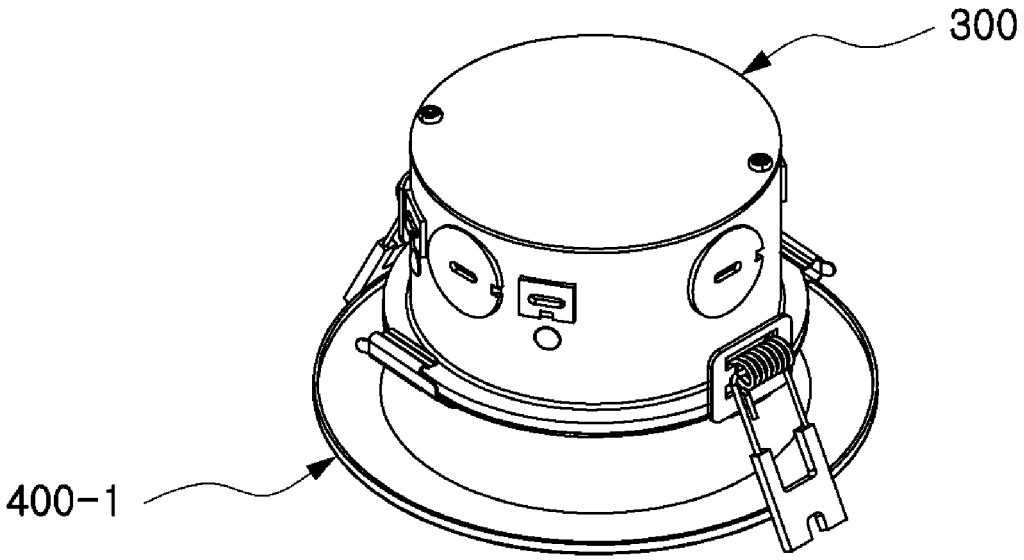
Figure 2C:
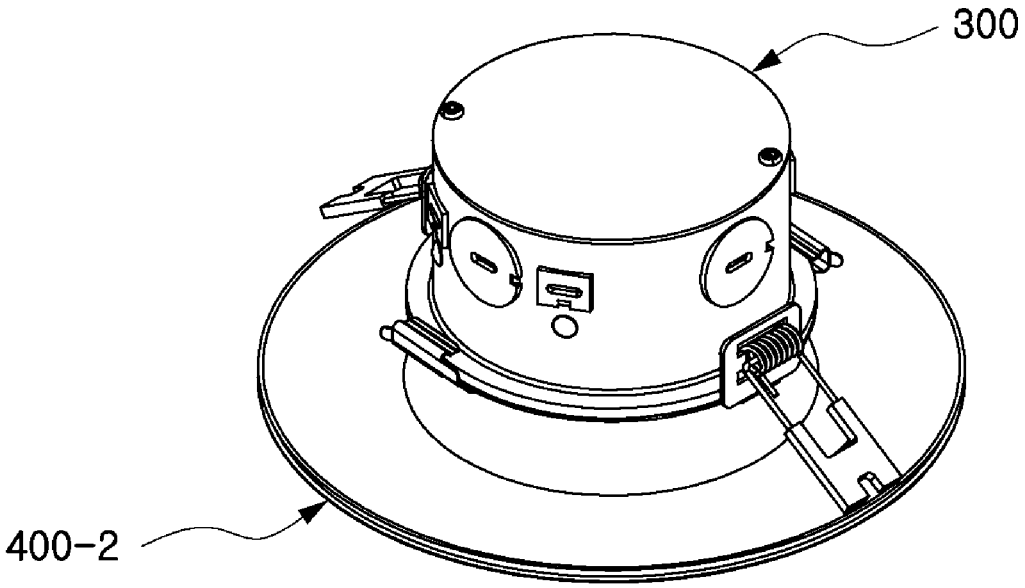
Figure 3:
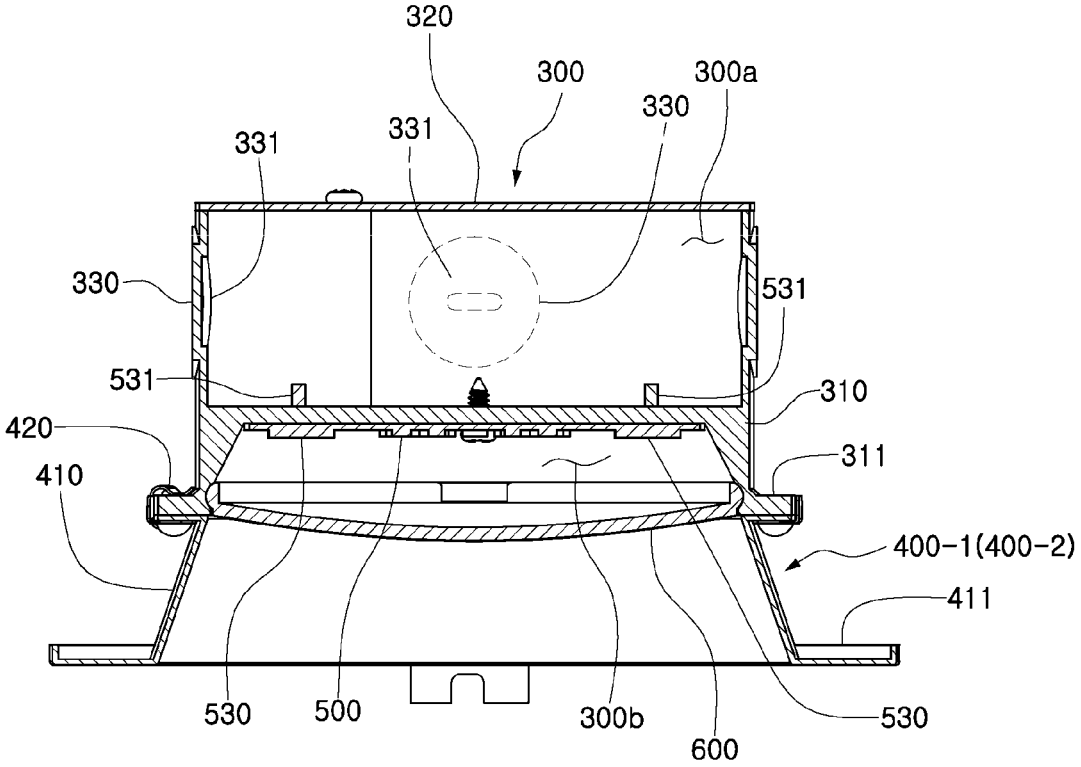
FIG. 3 is a longitudinal sectional view illustrating the side configuration of the slim-type LED lighting apparatus to which the trim illustrated in FIG. 2B
Figure 4:
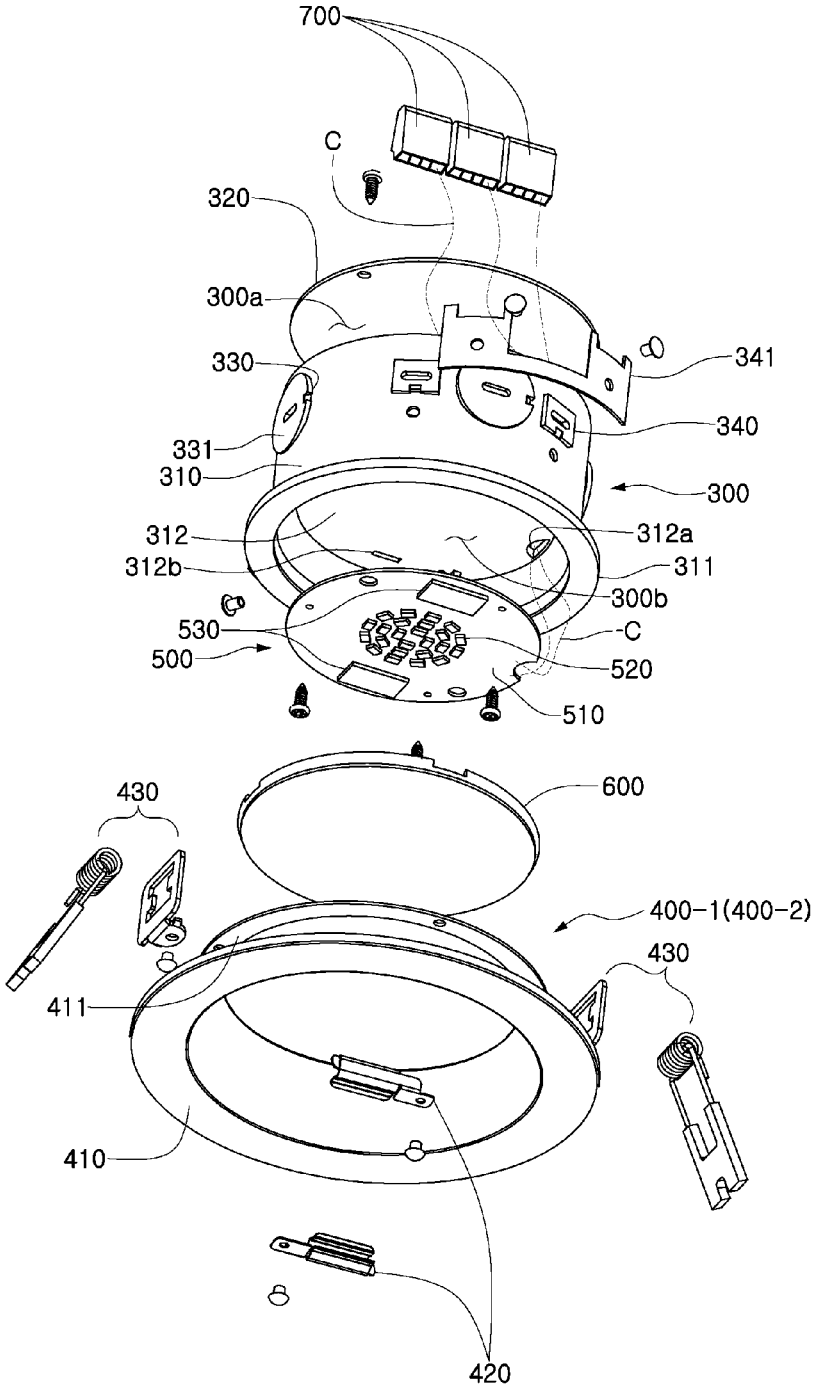
FIG. 4 is an exploded perspective view illustrating the slim-type LED lighting apparatus with integrated junction box and LED module according to the embodiment of the present disclosure.

FIGS. 2A to 2C are perspective views illustrating a slim-type LED lighting apparatus with integrated junction box and LED module according to an embodiment of the present disclosure, in which FIG. 2A illustrates a state before trims of different sizes are coupled to the junction box and the LED module, FIG. 2B illustrates a state in which a trim of 4 inches diameter is coupled, and FIG. 2C illustrates a state in which a trim of 6 inch diameter is coupled. FIG. 3 is a longitudinal sectional view illustrating the side configuration of the slim-type LED lighting apparatus to which the trim illustrated in FIG. 2B or FIG. 2C is applied. FIG. 4 is an exploded perspective view illustrating the slim-type LED lighting apparatus with integrated junction box and LED module according to the embodiment of the present disclosure.

Referring to FIGS. 2A to 4, the configuration of the slim-type LED lighting apparatus with integrated junction box and LED module according to the present disclosure will be described. First, the junction box 300 having a cylindrical shape is provided at the top of the lighting apparatus according to the present disclosure.

The junction box 300 includes a cylindrical body 310 with an open upper side and a recessed lower side recessed to a predetermined depth, and a plurality of first cable inlets 330 arranged on the circumference of a side surface of the cylindrical body 310 to allow circular cables or conduits (not illustrated) to be introduced thereinto.

In addition, the junction box 300 includes an upper opening 300*a* into which a wiring cover 320 is coupled to be selectively openable and closable for wiring work, and a lower recess 300*b* having a first flange 311 protruding from the cylindrical body 310 by a predetermined width.

The LED module 500 is integrally coupled to a lower surface 312 of the junction box 300. The LED module 500 is inserted through the lower recess 300*b* of the junction box 300 and then is integrally coupled to the lower surface 312 of the junction box 300 in face-to-face contact therewith.

Here, the LED module 500 is integrally coupled to the lower surface 312 of the junction box 300 in face-to-face contact therewith by screws or rivets. By the face-to-face contact between the LED module 500 and the lower surface 312 of the junction box 300, heat generated by the LED module 500 may be transferred to the junction box 300 through the lower surface 312 of the junction box 300 and then dissipated into the air.

A plurality of interchangeable trims 400-1 and 400-2 of different diameters are selectively provided in a lower portion of the junction box 300 to be interchangeable with each other, so that the interchangeable trims 400-1 are 400-2 are used by being interchanged in correspondence to a desired size depending on lighting interior design specifications or work environment.

Therefore, according to the present disclosure, the interchangeable trims 400-1 and 400-2 of different sizes required for one junction box 300 can be simply interchanged and used in the field. As a result, unlike the related art, it is not necessary to manufacture each different sized trim and a corresponding junction box and combine the same in the manufacturing stage That is, according to the present disclosure, the plurality of interchangeable trims 400-1 and 400-2 of different sizes are provided for one junction box 300, and when used in the field, one of the interchangeable trims 400-1 and 400 that has a desired size is selected and can be simply assembled to the lower portion of the junction box 300.

The interchangeable trims 400-1 and 400-2 may have various diameters depending on design specifications. As an example, an interchangeable trim of 4 inches diameter is illustrated in FIG. 2B, and a interchangeable trim of 6 inch diameter is illustrated in FIG. 2C.

Each of the interchangeable trims 400-1 and 400-2 of different diameters may have a second flange 411 protruding from an upper end thereof by a width corresponding to that of the first flange 311 at a lower side of the junction box 300. A plurality of rotation clips 420 are provided on the circumference of the second flange 411.

Therefore, it is understandable that when an operator selectively rotates the rotation clips 420 toward the first and second flanges 311 and 411, the rotation clips 420 are simultaneously clamped and secured to the first flange and the second flanges 311 and 411, so that one of the interchangeable trims 400-1 and 400-2 that has a desired size can be easily assembled to the lower end of the junction box 300.

Each of the first cable inlets 330 of the junction box 300 is normally blocked by a knockout plug 331 inserted thereinto. When an operator needs to perform wiring connection, he or she removes the respective knockout plugs 331 by turning the same with a screwdriver or the like, and then inserts circular cables or conduits (not illustrated) into the first cable inlets 330 to connect the same to the inside of the junction box 300.

A second cable inlet 340 having a rectangular opening to allow a flat cable having a flat cross-section to be introduced thereinto may be further formed between each of the first cable inlets 330.

Here, a holder plate 341 is further provided on rear surfaces of the respective second cable inlets 340 inside the junction box 300 to press the respective flat cables inserted into the second cable inlets 340 so as not to become loose and come out of the inlets 340.

For example, in a state in which flat cables C having a flat cross-section, such as Romex cables, which are a representative example of flat cables, are inserted into the second cable inlets 340, the holder plate 341 securely presses the cables C so as not to come out of the inlets 340.

The circular cables or conduits (not illustrated) introduced into the junction box 300 through the first cable inlets 330 or the flat cables C introduced into the junction box 300 through the second cable inlets 340 are electrically connected to the LED module 500 through a wiring hole 312*a* formed in the lower surface 312 of the junction box 300.

A lens 600 is further provided in the lower recess 300*b* of the junction box 300 to cover the LED module 500 integrally coupled to the lower surface 312 of the junction box 300.

The lens 600 serves to diffuse the light emitted from the LED module 500 or to protect the LED module 500 from being damaged.

A plurality of spring clips 430 are further coupled to a lower surface of the second flange 411 of each of the interchangeable trims 400-1 and 400-2. In a state in which the interchangeable trim 400-1 or 400-2 is embedded in an installation hole (not illustrated) of a ceiling surface (not illustrated), the spring clips 430 elastically press the top of the ceiling surface to secure the interchangeable trim 400-1 or 400-2 to the ceiling surface.

The LED module 500 is configured such that when viewed from below, a plurality of LED devices 520 are centrally disposed on a circular printed circuit board (PCB) (510), and a color temperature conversion switch and a power control switch 530 are provided on the printed circuit board 510 at left and right sides of the LED devices 520, respectively.

Each of the color temperature conversion switch and the power control switch 530 has a lever 531. The respective levers 531 protrude from an upper surface of the printed circuit board 510 and are exposed inside the junction box 300 through respective switch lever slots 312*b*, each of which is formed at a side of the lower surface 312 of the junction box 300.

Therefore, when the operator needs to operate the levers 531 of the color temperature conversion switch or the power control switch 530, he or she first opens the wiring cover 320 at the top of the junction box 300 and then manually operates the lever 531 protruding through an associated one of the switch lever slots 312*b* inside the junction box 300.

Referring to FIG. 4, a cable connector 700 is further provided inside the junction box 300. In this case, the operator first opens the wiring cover 320 at the top of the junction box 300 and then connects the cables C introduced into the junction box 300 through the first or second cable inlets 330 or 340 to each other by the cable connector 700.

Unexplained reference numeral 410 illustrated in FIGS. 2A to 2C denotes a body of each of the interchangeable trims 400-1 and 400-2.

The present disclosure is not limited only to the above-described embodiment, and the same effect can be attained even if the detailed configuration, number, and arrangement of the apparatus are changed. Accordingly, those of ordinary skill in the art will appreciate that various additions, deletions, and modifications are possible within the scope of the technical spirit of the present disclosure.

What is claimed is:

1. A slim-type LED lighting apparatus with integrated junction box and LED module, the apparatus comprising:

the junction box having a plurality of first cable inlets that allow circular cables or conduits to be introduced thereinto and are arranged on a circumference of a side surface of a cylindrical body with an open upper side and a recessed lower side recessed to a predetermined depth, an upper opening into which a wiring cover is coupled to be selectively openable and closable for wiring work, and a lower recess having a first flange protruding from the cylindrical body by a predetermined width;

the LED module is inserted through the lower recess of the junction box and then integrally coupled to a lower surface of the junction box in face-to-face contact therewith; and a plurality of interchangeable trims of different diameters selectively coupled to a lower portion of the junction box and configured to be interchangeable with each other.

2. The apparatus of claim 1, wherein each of the interchangeable trims of different diameters has a second flange protruding from an upper end thereof by a width corresponding to that of the first flange at a lower side of the junction box, and a plurality of rotation clips are provided on a circumference of the second flange, wherein when the rotation clips are selectively rotated toward the first and second flanges, the rotation clips are simultaneously clamped and secured to the first flange and the second flanges.

3. The apparatus of claim 1, wherein each of the first cable inlets of the junction box is blocked by a knockout plug inserted thereinto, or the respective knockout plugs are removed and then the circular cables or conduits are inserted into the first cable inlets and connected to the inside of the junction box.

4. The apparatus of claim 3, wherein a second cable inlet having a rectangular opening to allow a flat cable having a flat cross-section to be introduced thereinto is further formed between each of the first cable inlets.

5. The apparatus of claim 3, wherein the circular cables or conduits introduced into the junction box through the first cable inlets or the respective flat cables introduced into the junction box through the second cable inlets are electrically connected to the LED module through a wiring hole formed in the lower surface of the junction box.

6. The apparatus of claim 1, wherein a lens is further provided in the lower recess of the junction box to cover the LED module integrally coupled to the lower surface of the junction box.

7. The apparatus of claim 1, wherein as the LED module is integrally coupled to the lower surface of the junction box by the face-to-face contact therebetween, heat generated from the LED module is transferred to the junction box through the lower surface of the junction box and then dissipated into the air.

8. The apparatus of claim 1, wherein a plurality of spring clips are further coupled to a lower surface of the second flange of each of the interchangeable trims to secure the interchangeable trim to a ceiling surface by elastically pressing top of the ceiling surface in a state in which the interchangeable trim is embedded in an installation hole of the ceiling surface.

9. The apparatus of claim 1, wherein the LED module is configured such that when viewed from below, a plurality of LED devices are centrally disposed on a circular printed circuit board, and a color temperature conversion switch and a power control switch are provided on the printed circuit board at left and right sides of the LED devices, respectively.

10. The apparatus of claim 1, wherein each of the color temperature conversion switch and the power control switch has a lever, and the respective levers protrude from an upper surface of the printed circuit board and are exposed inside the junction box through respective switch lever slots, each of which is formed at a side of the lower surface of the junction box, wherein when the switches are needed to be operated, the wiring cover is opened and then the levers protruding through the switch lever slots inside the junction box are operated.

11. The apparatus of claim 1, wherein the LED module is integrally coupled to the lower surface of the junction box in face-to-face contact therewith by screws or rivets.

12. The apparatus of claim 5, wherein a cable connector is further provided inside the junction box to allow the cables introduced into the junction box through the first or second cable inlets to be connected to each other.

13. The apparatus of claim 4, wherein a holder plate is further provided on rear surfaces of the respective second cable inlets inside the junction box to press the respective flat cables inserted into the second cable inlets so as not to become loose and come out of the second cable inlets.

* * * * *